US010780557B2

(12) United States Patent
Wolzak

(10) Patent No.: US 10,780,557 B2
(45) Date of Patent: Sep. 22, 2020

(54) SLUGGING WRENCH

(71) Applicant: AC Safety Tools SA, Marly (CH)

(72) Inventor: John Wolzak, Wormer (NL)

(73) Assignee: AMPCO METAL S.A., Marly (CH)

( * ) Notice: Subject to any disclaimer, the term of this patent is extended or adjusted under 35 U.S.C. 154(b) by 876 days.

(21) Appl. No.: 14/379,143

(22) PCT Filed: Feb. 15, 2013

(86) PCT No.: PCT/NL2013/050097
§ 371 (c)(1),
(2) Date: Aug. 15, 2014

(87) PCT Pub. No.: WO2013/133693
PCT Pub. Date: Sep. 12, 2013

(65) Prior Publication Data

US 2016/0016296 A1 Jan. 21, 2016

(30) Foreign Application Priority Data

Feb. 15, 2012 (NL) ..... 2008298

(51) Int. Cl.
*B25B 19/00* (2006.01)
*B25B 13/04* (2006.01)
(Continued)

(52) U.S. Cl.
CPC ..... *B25B 19/00* (2013.01); *B25B 13/04* (2013.01); *B25B 13/06* (2013.01); *B25B 13/08* (2013.01);
(Continued)

(58) Field of Classification Search
CPC ..... B25B 19/00; B25B 13/04; B25B 13/06; B25B 13/08; B25B 13/58; B25B 13/107; B25B 27/18; B25B 13/48
(Continued)

(56) References Cited

U.S. PATENT DOCUMENTS 3,802,303 A * 4/1974 Evans ..... B25B 13/107 81/119
4,774,862 A * 10/1988 Scull ..... B25B 13/08 81/119
(Continued)

FOREIGN PATENT DOCUMENTS

FR 2883787 A1 10/2006
FR 2906487 A1 4/2008
WO 2004113025 A1 12/2004

*Primary Examiner* — Hadi Shakeri
*Assistant Examiner* — Katina N. Henson
(74) *Attorney, Agent, or Firm* — Christensen O'Connor Johnson Kindness PLLC

(57) ABSTRACT

The present invention relates to a slugging wrench for exerting slugging force on a fastening member such as a nut during tightening or loosening thereof, the slugging wrench comprising: an arm, an impact absorbing element arranged on the arm for absorbing the slugging force, a receiving member for receiving the fastening member, wherein the receiving member is provided with an inner surface fitting in force-transmitting manner on an outer surface of the fastening member and preferably having in a view, such as in the in-feed direction, a shape such as a polygon, such as a hexagon, such as a dodecagon, wherein the inner surface is provided with two grooves suitable for receiving a clamping member for the purpose of providing a clamping action in respect of the fastening member.

23 Claims, 4 Drawing Sheets

(51) Int. Cl.

| | |
|---|---|
| ***B25B 13/08*** | (2006.01) |
| ***B25B 13/10*** | (2006.01) |
| ***B25B 13/06*** | (2006.01) |
| ***B25B 13/58*** | (2006.01) |
| *B25B 27/18* | (2006.01) |
| *B25B 13/48* | (2006.01) |

(52) U.S. Cl.
CPC ..... *B25B 13/107* (2013.01); *B25B 13/58* (2013.01); *B25B 13/48* (2013.01); *B25B 27/18* (2013.01)

(58) Field of Classification Search
USPC ..... 81/125, 57.34, 177.8, 119, 13, 57.16, 81/186, 53.2
See application file for complete search history.

(56) References Cited

U.S. PATENT DOCUMENTS

| | | | | |
|---|---|---|---|---|
| 6,116,118 | A * | 9/2000 | Wesch, Jr. | E21B 19/161 81/57.16 |
| 6,889,581 | B2 * | 5/2005 | Chen | B25B 13/04 81/125 |
| 7,107,879 | B1 * | 9/2006 | Cheng | B25B 13/04 81/121.1 |
| 2005/0000329 | A1 | 1/2005 | Pregeant | |
| 2006/0236822 | A1 * | 10/2006 | Nish | B25B 23/108 81/125 |

* cited by examiner

SLUGGING WRENCH

CROSS-REFERENCE TO RELATED APPLICATIONS

This application is the United States national phase of International Application No. PCT/NL2013/050097 filed Feb. 15, 2013, and claims priority to Netherlands Patent Application No. nl2008298 filed Feb. 15, 2012, the disclosures of which are hereby incorporated in their entirety by reference.

The present invention relates to a slugging wrench for exerting slugging force on a fastening member such as a nut during tightening or loosening thereof.

Slugging wrenches are per se known devices used to transmit a slugging force to a nut when the nut is too tightly fixed to be able to remove, loosen or tighten it without the slugging force. A slugging wrench is provided for this purpose with a slugging surface, preferably arranged opposite the ring on a handle, which can be struck with a hammer.

Although the advantage of using a prior art slugging wrench is apparent, a significant drawback is that many injuries occur during use because the hand holding the wrench on the nut is struck by the hammer. Such injuries cause much personal distress and result in much operational damage.

In order to prevent such drawbacks of the prior art in the future the present invention provides a slugging wrench for exerting slugging force on a fastening member such as a nut during tightening or loosening thereof, the slugging wrench comprising:

- an arm,
- an impact absorbing element arranged on the arm for absorbing the slugging force,
- a receiving member for receiving the fastening member, wherein the receiving member is provided with an inner surface fitting in force-transmitting manner on an outer surface of the fastening member and preferably having in a view, such as in the in-feed direction, a shape such as a polygon, such as a hexagon, such as a dodecagon,
- wherein the inner surface is provided with at least two grooves respectively suitable for receiving a clamping member for the purpose of providing a clamping action in respect of the fastening member.

An advantage of such a slugging wrench according to the present invention is that, due to the clamping action in respect of the fastening member, the slugging wrench remains positioned without being held fast by the hand. It hereby becomes possible to avoid injury. Greater concentration can further be focused on striking in correct manner, whereby slugging takes place more carefully and there is better focus on the correct orientation of the slugging force. A further advantage of a device according to at least a preferred embodiment according to the present invention is that, when a clamping member clamps round a fastening member, the fastening member is clamped firmly in the receiving member, which is in turn held fast in the respective groove.

According to a first preferred embodiment of the present invention, the slugging wrench comprises at least the one clamping member, preferably per groove, wherein the clamping member is substantially circular, or wherein the clamping member is substantially polygonal so as to substantially match the shape of the inner surface.

It is advantageous here for a clamping action to be imparted to the fastening member. The substantially circular variant provides clamping action at the vertices of a fastening member such as a nut. The substantially polygonal variant, or star-shaped variant, can provide clamping action at the vertices of a fastening member such as the nut or, conversely, provide clamping action on the flat parts of a fastening member such as the nut. The clamping member therefore more preferably provides a clamping force here to the vertices of the fastening member which define a circumscribed circle, and/or flat parts of the fastening member.

In a further preferred embodiment the clamping member provides a spring force and preferably comprises for this purpose a metal, such as preferably steel, such as more preferably processed steel such as spring steel. Such a robust embodiment provides a strong clamping action or spring force.

The inner surface of the ring of the slugging wrench is more preferably dimensioned relative to standard sizes of fastening members in order to provide a certain play between the outer surface of the fastening member and the inner surface of the slugging wrench, wherein the depth of the groove is smaller than a diameter of the material of the clamping member, preferably less than 0.9 times the diameter, more preferably less than 0.8 times the diameter, more preferably less than 0.6 times the diameter.

Such an embodiment assists in providing a greater stability of the slugging wrench relative to the fastening member, since it contributes toward reducing the play between the fastening member and the inner surface of the ring of the slugging wrench. A slugging wrench has a relatively large play between the outer surface of the fastening member and the inner surface of the ring of the slugging wrench. The slugging wrench can hereby be arranged easily and can also be arranged when the outer surface of the fastening member is damaged. Such a large play has the drawback that the slugging wrench easily detaches from or falls off the fastening member. A slugging wrench according to the present invention assists in reducing or obviating such a drawback.

In a further preferred embodiment a centre-to-centre distance of an outer groove or outer clamping member relative to the height of the inner surface is arranged at 0.10.4 or 0.60.9 of the height of the inner surface relative to the underside or the upper side. Hereby achieved in advantageous manner is that the effective force of the clamping members is great due to the relatively large mutual distance.

It is advantageous in the slugging wrench according to the present invention when in a preferred embodiment the clamping member is an open ring or retaining ring. Hereby achieved is that this member can be placed and removed, or replaced, in simple manner. Replacement can be advantageous when the clamping member becomes damaged or the spring force decreases. Such a measure also provides for interchange ability between different types of clamping member.

When in an embodiment the clamping member and/or the clamping members define in the slugging wrench a clamping plane which preferably has a substantially cylindrical shape with some height and which more preferably extends over at least 80%, preferably 90% of the periphery of a cylinder, this achieves that a relatively great force for holding the slugging wrench relative to the fastening member is realized relative to the size of the ring of the slugging wrench.

In a further preferred embodiment the inner diameter of the clamping member in non-tensioned state is smaller than a circumscribed circle of the fastening member intended for the slugging wrench, is more preferably smaller than an inscribed circle of the inner surface, is more preferably smaller than a circle of the inner surface defined by outward pointing vertices of the star formed by the inner surface. A clamping force is hereby obtained on the fastening member in advantageous manner. Also achieved is that the clamping member can of itself exert a force on the fastening member, after which, due to the presence of the clamping member in the groove, the surfaces of the groove hold the clamping member fast, thereby achieving that the play between the fastening member and the inner surface is of minor importance. No matter how the clamping member or the clamping members with the fastening member arranged therein may be oriented relative to the groove of the slugging wrench, the clamping members are always held fixedly by the groove.

In a further preferred embodiment the slugging wrench comprises a stop for positioning the clamping member in a rotational direction which is preferably arranged in at least one of the respective grooves. Particularly in the case of a noncircular clamping member this achieves that the positioning of the clamping member in rotational direction is of a shape similar to the form of the inner surface. The clamping member more preferably has substantially a star shape on the inner side thereof, preferably in the form of a substantially wire-like ring with bends. It hereby becomes possible for the clamping member to clamp over a greater part of the length thereof for the purpose of a better clamping relative to the fastening member.

When bulges are arranged on the inner side of the clamping member for engagement thereof on the fastening member, a relatively firm clamping is realized during holding of the fastening member.

The clamping member is more preferably embodied as a flat retaining ring.

The clamping member more preferably comprises pressing bulges for pressing against the outer wall of the groove.

A pressing surface of the groove more preferably comprises bulges for pressing the clamping member against the fastening member.

In the slugging wrench according to one or more of the foregoing claims the receiving member comprises in a further preferred embodiment at least one opening for providing a lateral passage for the fastening member. Using such an opening an operation as in the case of an opened wrench is provided in a slugging wrench according to the present invention. This is advantageous for instance in the case the fastening member cannot be reached by means of an annular receiving member, and the lateral insertion provides the solution here-for.

Further advantages, features and details of the present invention will be described in greater detail herein-below on the basis of one or more preferred embodiments with reference to the accompanying figures. Similar, though not necessarily identical, components of different preferred embodiments are designated with the same reference numerals.

Figure 1:
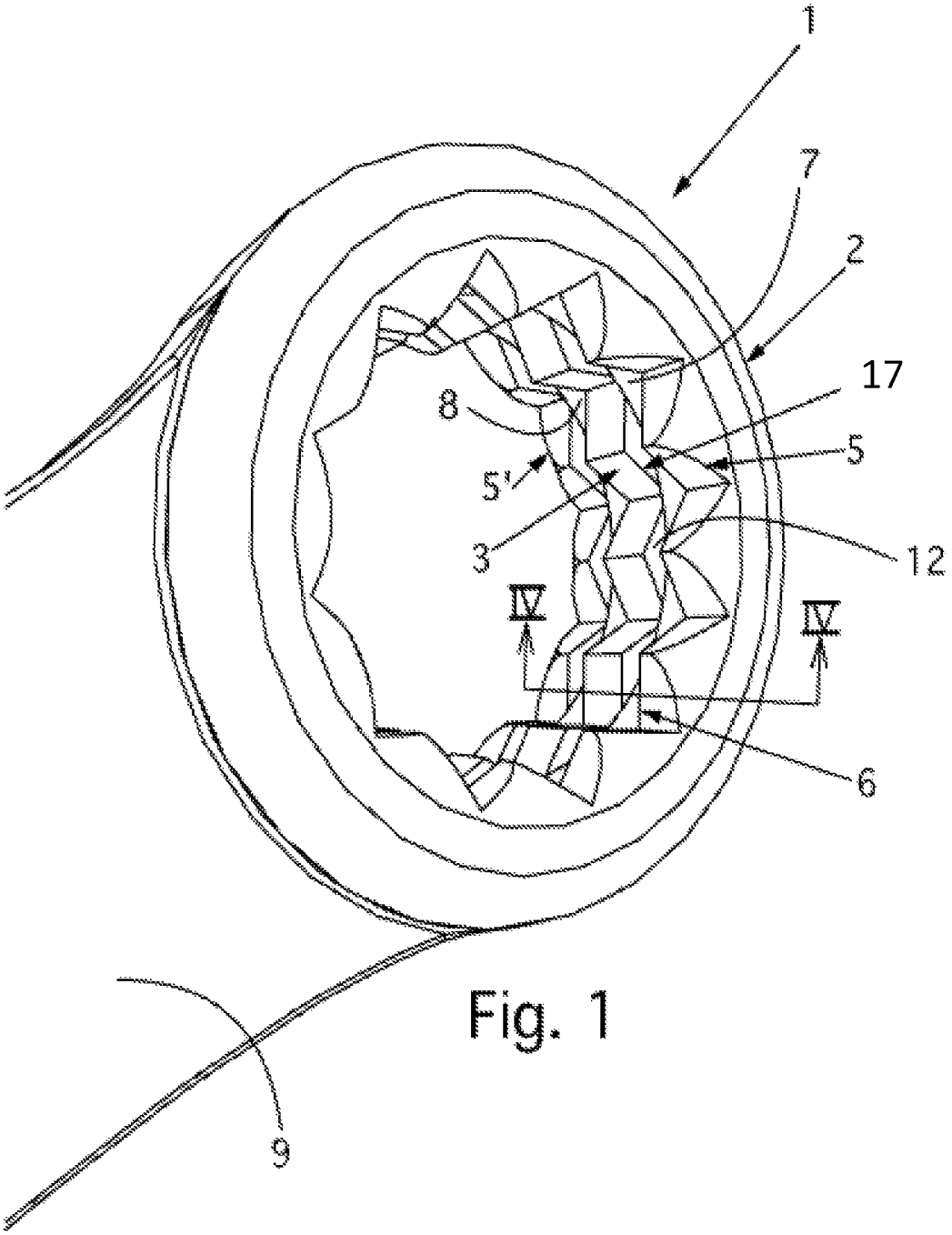
FIG. 1 is a perspective view of a first preferred embodiment according to the present invention.

A first preferred embodiment (FIG. 1) according to the present invention relates to a slugging wrench 1 having an arm 9 and a receiving member 17. This comprises clamping rings (clamping members) 7, 8 arranged in a groove 6 on the inner side of ring 2 of the slugging wrench. Although the ring can be a hexagon, the present ring is a dodecagon. A central part of ring 2 of the slugging wrench is formed by nut engaging surfaces 3, and situated on the upper side are nut engaging surfaces 5 and on the underside nut engaging surfaces 5'. Arranged therebetween are two grooves 12 which can for instance be formed by a milling operation. The dual embodiment of grooves 12 and the clamping rings 7, 8 arranged therein provides a relatively high clamping force relative to the nut (not shown).

Figure 2:
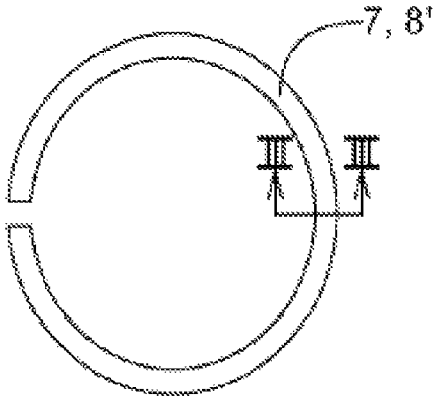
FIG. 2 is a schematic top view of a further preferred embodiment.

FIG. 2 shows that clamping rings 7, 8 are substantially circular with a recess with an opening, whereby they can be bent so far inward that they can be placed in a groove after the groove has been arranged in the ring of the slugging wrench.

Figure 3A:
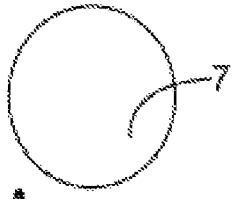
FIG. 3 shows two further preferred embodiments in cross-section.
Figure 3B:
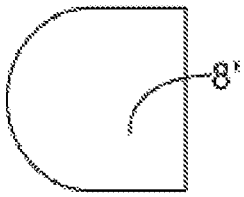

FIG. 3 shows cross-sections of two variants of ring 7, 8. Ring 7 is manufactured from a substantially wire-like material of for instance spring steel. The rounding of the wire-like material makes it possible for the nut to be pressed through the ring, wherein the ring is forced outward. Ring 8 is a variant in flat steel material. For the purpose of obtaining the same action as ring 7, it is provided on the inner side with a curvature or chamfering so that the ring is pressed outward during placing of the slugging wrench on a nut.

Figure 4:
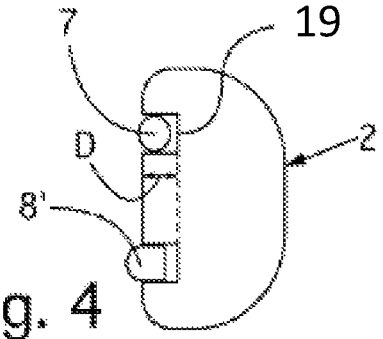
FIG. 4 shows a cross-sectional detail of the embodiment according to FIG. 1.

FIG. 4 shows a cross-section of ring 2 of the slugging wrench according to FIG. 1 along the line IVIV. In this preferred embodiment the depth (D1) of the groove is no deeper than the cross-section of the ring or the thickness of the ring as seen in top view, at least at the locations of the ring wrench where the vertices of the nuts can be placed. This achieves that the ring can provide a clamping action between rear wall 19 of the groove and the nut.

Figure 5:
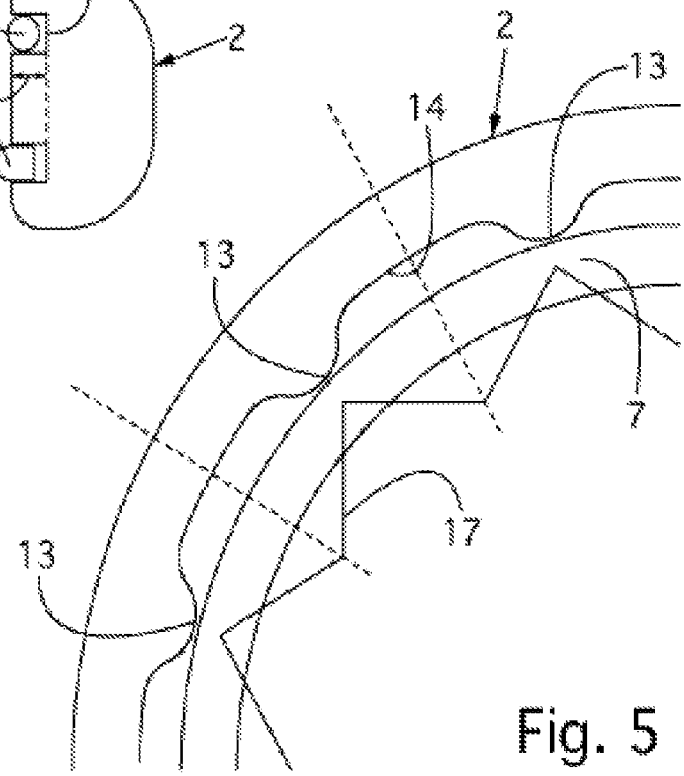
FIG. 5 shows a cross-sectional detail of a further preferred embodiment.
Figure 6:
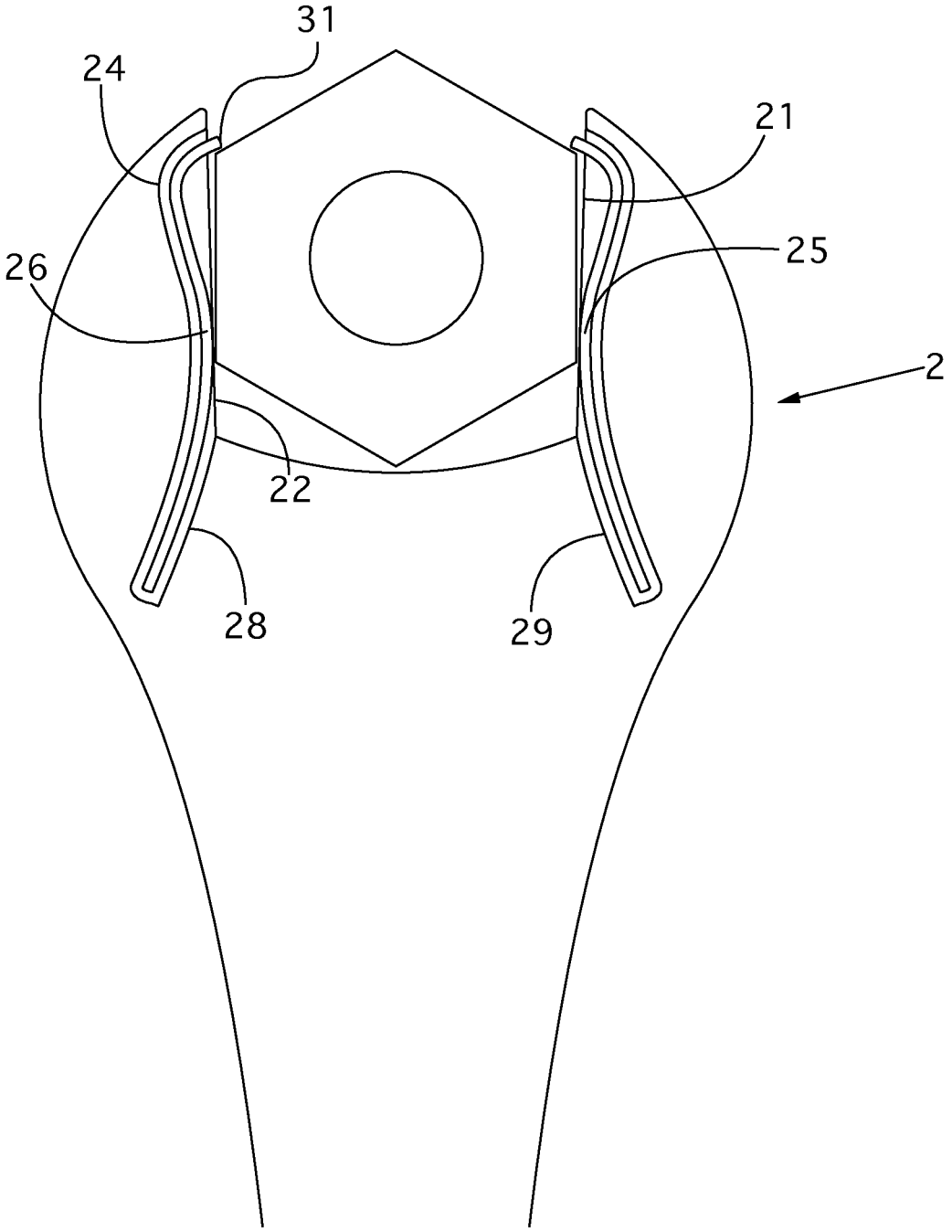
FIG. 6 shows a detail of a further preferred embodiment.
Figure 7:
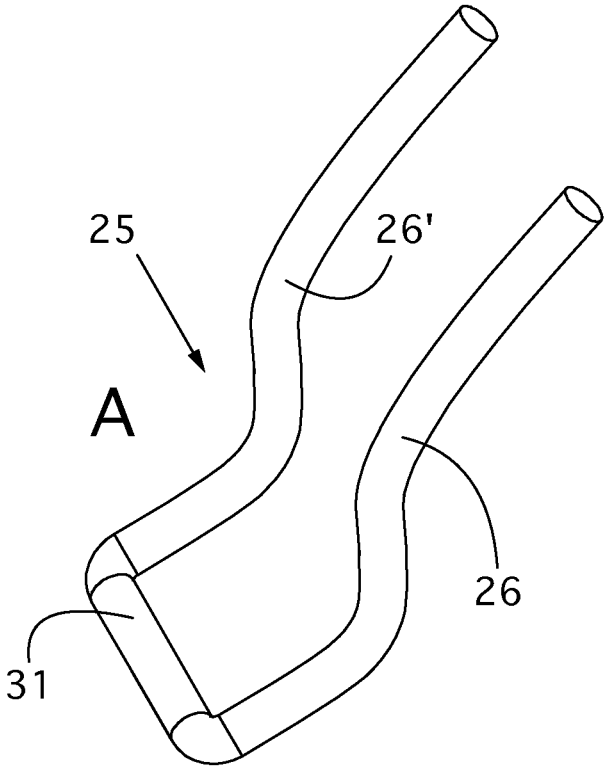
FIG. 7 shows a perspective, front and side view of a detail of the embodiment according to FIG. 6.
Figure 7:
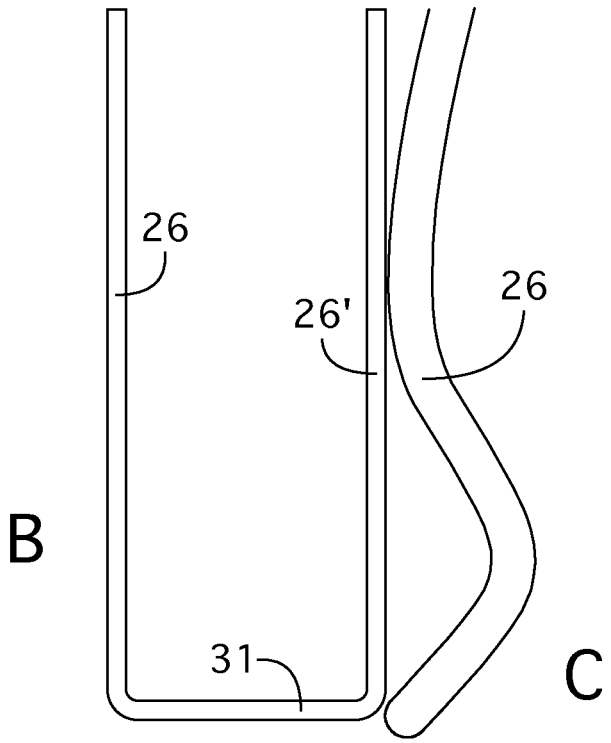

FIG. 5 shows a further variant wherein the rear wall 14 of the groove is provided with protrusions or bulges 13 for the purpose of providing a stop for the outer side of the ring 7 there-against. The positioning of these bulges 13 is such that it corresponds substantially to the centre of the surfaces 17 of the nut. A material tension can hereby be realized in the resilient ring 7 between bulges 13 and the vertices of the nut, whereby a strong spring force is realized in an alternative manner between the groove and the nut by means of ring 7.

A preferred embodiment is embodied as open-end wrench, whereby the ring is open on one side with an opening which is substantially slightly larger than one of the side views of the nut. The head of this open-end wrench is shown from the top in a sectional view. As is per se usual in the case of an open-end wrench, it comprises two nut engaging surfaces 21, 22 for engaging a nut.

As in previous preferred embodiments, grooves 24 are arranged in these engaging surfaces 21, 22 for receiving two springs 25, 26, one on each side of the head. The springs extend from a placing recess 28, 29 in a respective groove with a variable depth. Realized by means of this variable depth of the groove is that the spring can move outward during placing of the nut in the head, such as between surfaces 21, 22.

When the nut is inserted, the springs bring about engagement on either side of two opposite side surfaces of the nut. An end part 31 of the spring optionally engages round the placed nut. Alternatively, the lateral clamping of the springs will suffice.

For the purpose of the dual embodiment of the spring on either side, the spring is embodied as if it were a bent staple.

The spring has for this purpose two legs 26, 26' and an end bridge element 31 for the mutual connection. Realized in advantageous manner by means of such a preferred embodiment is that damage to spring end parts is prevented.

The present invention has been described in the foregoing on the basis of several preferred embodiments. Different aspects of different embodiments are deemed described in combination with each other, wherein all combinations which can be deemed by a skilled person in the field as falling within the scope of the invention on the basis of reading of this document are included. These preferred embodiments are not limitative for the scope of protection of this document. The rights sought are defined in the appended claims.

The invention claimed is:

1. A slugging wrench configured for exerting a slugging force on a fastening member during tightening or loosening thereof when hit with a hammer, the slugging wrench comprising:

an arm;

a receiving member integrated into an end of the arm, comprising a hole along an in-feed direction of the fastening member and configured for receiving the fastening member, the receiving member having an inner surface completely surrounding the hole radially and configured to fit, in force-transmitting manner, on an outer surface of the fastening member, and, comprising at least two wall parts having in a view, in the in-feed direction, a polygonal shape; and at least first and second clamping rings configured for providing a clamping action on the fastening member to retain the slugging wrench in position on the fastening member without being hand-held when located within the receiving member, wherein the inner surface of the receiving member is provided with at least two radial grooves respectively configured for receiving one of the first and second clamping rings, wherein the inner surface of the receiving member is configured to have a first nut engaging surface at a central part thereof, with situated, on the upper side and underside thereof in the in-feed direction, second and third nut engaging surfaces with the two radial grooves arranged therebetween in the in-feed direction in such a way that, along the in-feed direction, the slugging wrench has, in this order, the second nut engaging surface, the first clamping ring, the first nut engaging surface, the second clamping ring, and the third nut engaging surface, and wherein a rear wall of the radial grooves comprises bulges for pressing the clamping rings against the fastening member.

2. The slugging wrench as claimed in claim 1, wherein each of the first and second clamping rings corresponds to one of the at least two grooves, and wherein each clamping ring is circular, or wherein each clamping ring is polygonal so as to match the shape of the inner surface.

3. The slugging wrench as claimed in claim 1, wherein each of the first and second clamping rings provide a clamping force to the vertices of the fastening member which define a circumscribed circle or to flat parts of the fastening member.

4. The slugging wrench as claimed in claim 1, wherein the first and second clamping rings are made of a resilient metal providing a spring force when pressed on the bulges.

5. The slugging wrench as claimed in claim 1, wherein the inner surface is dimensioned relative to standard sizes of fastening members in order to provide a predetermined clearance between the outer surface of the fastening member and the inner surface of the slugging wrench, wherein the depth of the radial grooves is smaller than the difference between outer and inner radii of the first and second clamping rings.

6. The slugging wrench as claimed in claim 1, wherein each of the first and second clamping rings is an open ring or retaining ring.

7. The slugging wrench as claimed in claim 1, wherein each of the first and second clamping rings defines a clamping plane which has a cylindrical shape with some height and which extends over at least 80% of the periphery of a cylinder.

8. The slugging wrench as claimed in claim 1, wherein an inner diameter of each of the first and second clamping rings in non-tensioned state is smaller than a circumscribed circle of the fastening member intended for the slugging wrench.

9. The slugging wrench as claimed in claim 1, comprising a stop for positioning each of the first and second clamping rings in a rotational direction which is arranged in one of the respective radial grooves.

10. The slugging wrench as claimed in claim 1, wherein each of the first and second clamping rings has a star shape on the inner side thereof, in the form of a wire-like ring with bends.

11. The slugging wrench as claimed in claim 1, wherein bulges for engaging on the fastening member are arranged on the inner side of each of the first and second clamping rings.

12. The slugging wrench as claimed in claim 1, wherein each of the first and second clamping rings is embodied as a flat retaining ring.

13. The slugging wrench as claimed in claim 1, wherein each of the first and second clamping rings comprises pressing bulges for pressing against the outer wall of the groove.

14. The slugging wrench as claimed in claim 1, wherein the receiving member comprises at least one opening for providing a lateral passage for the fastening member.

15. The slugging wrench as claimed in claim 1, wherein the at least two wall parts have in a view, in the in-feed direction, a hexagonal shape.

16. The slugging wrench as claimed in claim 1, wherein the at least two wall parts have in a view, in the in-feed direction, a dodecagonal shape.

17. The slugging wrench as claimed in claim 4, wherein the resilient metal is steel.

18. The slugging wrench as claimed in claim 4, wherein the resilient metal is spring steel.

19. The slugging wrench as claimed in claim 5, wherein the depth of the radial grooves is less than 0.9 times the difference between the outer and inner radii of the first and second clamping rings.

20. The slugging wrench as claimed in claim 8, wherein the inner diameter of each clamping ring in the non-tensioned state is smaller than an inscribed circle of the inner surface.

21. The slugging wrench as claimed in claim 1, wherein the bulges are distributed long an inner surface of the at least two radial grooves.

22. The slugging wrench as claimed in claim 1, wherein the at least two radial grooves are circular.

23. The slugging wrench as claimed in claim 1, wherein the first and second clamping rings are circular.

* * * * *